US005353554A

United States Patent [19]

Keizers

[11] Patent Number: 5,353,554

[45] Date of Patent: Oct. 11, 1994

[54] INJECTOR DOSING MEANS

[76] Inventor: Sigrid Keizers, Konigsberger Str. 2-4 D-4280, Borken/Westf., Fed. Rep. of Germany

[21] Appl. No.: 147,920

[22] Filed: Nov. 4, 1993

Related U.S. Application Data

[63] Continuation of Ser. No. 894,048, Jun. 4, 1992, abandoned.

[30] Foreign Application Priority Data

Mar. 25, 1992 [DE] Fed. Rep. of Germany ..... 4209552

[51] Int. Cl.[5] ..... B24C 7/00

[52] U.S. Cl. ..... 451/96; 451/2; 451/102

[58] Field of Search ..... 51/410, 415, 416, 436, 51/439; 222/132; 239/411, 415; 137/266

[56] References Cited

U.S. PATENT DOCUMENTS

| | | | |
|---|---|---|---|
| 4,689,923 | 9/1987 | Goudeaux | 51/436 |
| 4,707,952 | 11/1987 | Krasnoff | 51/436 |
| 4,709,515 | 12/1987 | Copeland | 51/436 |
| 4,821,467 | 4/1989 | Woodson | 51/436 |
| 4,878,320 | 11/1989 | Woodson | 51/436 |
| 4,977,921 | 12/1990 | Knight | 51/436 |
| 5,042,209 | 8/1991 | Furrer | 51/436 |
| 5,065,551 | 11/1991 | Fraser | 51/436 |

OTHER PUBLICATIONS

"Betonsanierung mittels Strahltechnik", Sep. 1988, pp. 31–35.

*Primary Examiner*—M. Rachuba
*Attorney, Agent, or Firm*—Kinney & Lange, P.A.

[57] ABSTRACT

The invention relates to an injector dosing mechanism (1) for an apparatus, in particular a sandblasting mechanism (30), for dosed addition to a liquid, such as anticorrosive agent, to a stream produced by the apparatus, having a container (2) for taking up the liquid and a connecting pipe (31) leading to the pipe (32) carrying the stream, the apparatus being operated via a switch-on mechanism (33). To permit a constant dosage of liquid without readjustment in a constant or varying air stream or even despite interruption of the air stream, a control valve (17, 18) controlled via a switching mechanism is disposed in the connecting pipe (31), the switching [means] mechanism being coupled with the switch-on [means] mechanism (33) of the apparatus and switching the control valve (17, 18) in accordance with the pulses from the switch-on [means] mechanism.

10 Claims, 2 Drawing Sheets

INJECTOR DOSING MEANS

This is a continuation of application Ser. No. 07/894,048, filed Jun. 4, 1992 now abandoned.

BACKGROUND OF THE INVENTION

1. Field of the Invention

The present invention relates to an injector dosing means for an apparatus, in particular a sandblasting means, for dosed addition of a liquid, such as anticorrosive agent, to a stream produced by the apparatus, having a container for taking up the liquid and a connecting pipe leading to the pipe carrying the stream, the apparatus being operated via a switch-on means.

In many industrial processes it is necessary to add one or more dosed agents to a mixed stream produced by an apparatus.

In particular in sandblasting it is necessary to add dosed agents. Since the objects treated by sandblasting are frequently metal, one adds anticorrosive agent to the mixed stream of the sandblaster to avoid the formation of rust after sandblasting. However it has hitherto not been possible to add it to the mixed stream of the sandblasting means in controlled fashion. The dosage of the liquid has sometimes been controlled via the compressed-air stream of the mixed stream, but problems always arise when the compressed-air stream varies or is interrupted. The dosed amount must then be readjusted to provide a sufficient amount of the liquid to be dosed. A further disadvantage of the known dosing means on a sandblaster is that the exact dosed amount required by a particular operating mode cannot always be added in that operating mode.

SUMMARY OF THE INVENTION

The invention is based on the problem of providing a dosing means of the aforesaid type which avoids these disadvantages and ensures optimal dosage in each operating mode of the apparatus.

This problem is solved according to the invention substantially by disposing in the connecting pipe a control valve controlled via a switching means. The switching means is coupled with a switch-on means of the apparatus and switches the control valve in accordance with the pulses from the switch-on means.

This makes it readily possible to add the proper dose of liquid to the stream of the apparatus or sandblasting means. The dosed addition is completely independent of whether the air stream in the sandblasting means is constant or varies or the air supply is even interrupted at times.

To realize the inventive control means, the switching means has a valve driven via the switch-on means of the apparatus, the switching means being connected with a pressure generator. The switching means further has a lifting cylinder pressurized via the valve, which is in turn connected with the control valve. This provides in a simple way a control means that works independently of the air stream of the sandblasting means and always ensures the desired dosage of liquid.

In a development of the inventive idea, the switch-on means of the apparatus or sandblasting means is designed as a remote control unit. The switching means of the dosing means accordingly has a receiver which feeds a control pulse to a drive of the valve. In another embodiment the switch-on means is connected electrically with the drive of the valve. These features ensure that when the sandblasting means is switched on or switched to a different operating mode the proper amount of dosed agent can always be added by the dosing means.

Since the sandblasting means is operated by compressed air and a compressor is already necessary for operating the sandblasting means, it is expedient to control the lifting cylinder pneumatically as well.

It is not only possible to control the control valve itself, i.e. the flow opening, in accordance with the operating mode of the sandblasting means. In a different embodiment of the invention the connecting pipe branches out or is branched in accordance with the number of operating modes, and each branch has a separately controlled control valve for the various operating modes of the sandblasting means. This is a simple way of ensuring that the dosed amount required for the particular operating mode is always added.

If only one valve is provided for controlling the control valves in the connecting branches it is necessary to dispose a further hand-operated valve behind each control valve, regarded in the direction of flow, to ensure the desired dosage.

Since different amounts of dosed agent must be added for different materials, the arrangement of a nozzle with suitable open cross section in the connecting pipe or each connecting branch offers the possibility of adjusting this amount to the corresponding maximum value.

Since different amounts of dosed agent are generally required in different operating modes of the dosing means, one can also give the nozzles of the various connecting branches different diameters.

The dosed addition of liquid is further improved by connecting the container of the injector dosing means with a pressure generator and making it pressure sealed. Since the sandblasting means requires a compressor for operation, as already mentioned, the container of the dosing means can also be connected therewith without a further pressure generator being necessary.

To empty the container completely it is expedient for the bottom of the container to be inclined toward the opening leading to the connecting pipe.

Finally, it is expedient to integrate the dosing means into the apparatus.

BRIEF DESCRIPTION OF THE DRAWINGS

Further features, advantages and possibilities of application for the following invention shall emerge from the description of an embodiment example with reference to the drawing, and with reference to the drawing itself, in which.

DETAILED DESCRIPTION OF THE PREFERRED EMBODIMENTS

Figure 1:
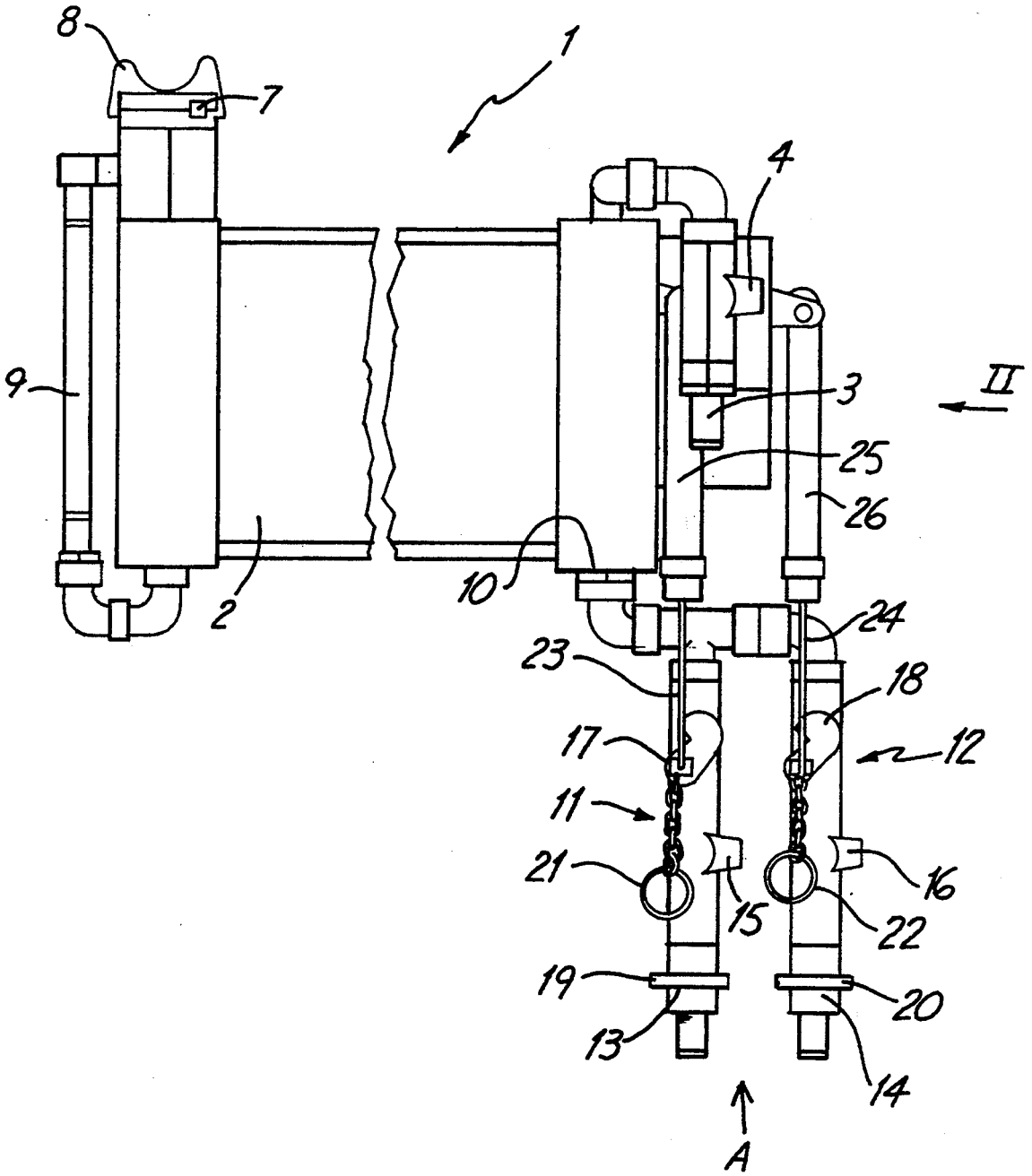
FIG. 1 shows a view of the inventive injector dosing means.
Figure 2:
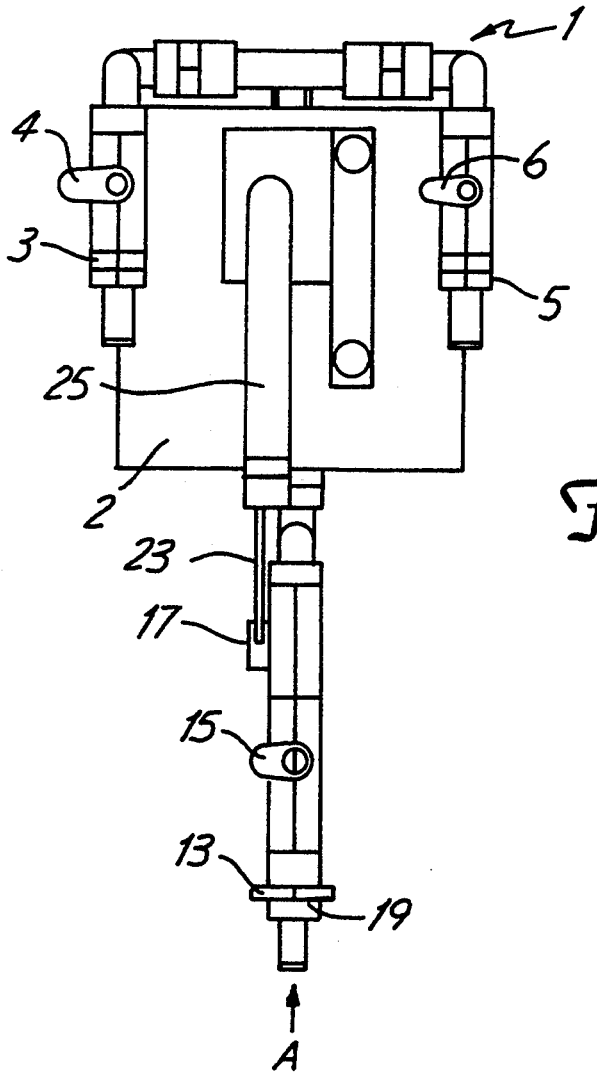
FIG. 2 shows a view of the injector dosing means of FIG. 1 in the dissection of arrow II, and FIG. 3 hows a diagram of an injector dosing means for a sandblasting means.

Injector dosing means 1 shown in FIGS. 1 and 2 has a container 2 serving firstly as a store tank for a liquid to be added and secondly for pressure buildup. This means that container 2 must have a pressure sealed design. A connection 3 is connected to container 2. Via connection 3 compressed air can be supplied to container 2. Connection 3 can be closed via a valve which is designed in the present case as a ball valve 4. In the shown example in FIG. 2, ball valve 4 is closed.

A further connection 5 is connected with connection 3 and thus also with container 2, being likewise closable via a valve which is also designed as a ball valve 6 here. Ball valve 6 is also shown in the closed state in the embodiment example of FIG. 2. The open state (not shown) of the ball valves results when ball valves 4, 6 point downward. Connection 5 serves substantially to vent container 2 or to let off pressure from container 2.

Connection 3 for the compressed air opens into container 2 in the upper area of container 2 so that the liquid to be conveyed is not eddied unnecessarily when compressed air is supplied.

Container 2 further has a filler neck 7 through which the liquid to be dosed can be poured in and which is disposed above container 2. Filler neck 7 can be closed by a removable cap 8. In the area of filler neck 7 there is a display tube 9. Display tube 9 is connected at its upper end with filler neck 7 and at its lower end with the bottom of container 2. Via display tube 9 one can check the volume of the liquid located in container 2. It is important for both display tube 9 and container 2 to be made of a material which cannot be attacked by the liquid located in container 2 or react with this liquid.

Container 2 further has a drain opening 10 which is located on the bottom of container 2. To permit container 2 to be emptied completely, the bottom of the container can slope toward drain opening 10, being for example funnel-shaped. Drain opening 10 is connected in the example of FIGS. 1 and 2 with two connections 11 and 12. Connections 11 and 12 contain, regarded from the connection side, a nozzle 13, 14, a valve designed as a ball valve 15, 16 and an externally controlled control valve 17, 18. Connections 11, 12 form part of a connecting pipe 31 to be described below.

Nozzles 13, 14 are taken up in corresponding nozzle holders designated as 19, 20. The diameter of nozzles 13, 14 depends on the required amount of liquid to be dosed and the coefficient of friction of the liquid. Ball valves 15, 16 correspond to ball valves 4, 6 of connections 3, 5 and are likewise adapted to be hand-operated. Externally controlled control valves 17, 18 are likewise designed as ball valves, pull elements in the form of pull rings 21, 22 being fastened to the ends of the ball valve handles. Piston rods 23, 24 of lifting cylinders 25, 26 are fastened to the ball valve handles, in particular likewise to the ends of the ball valve handles.

Lifting cylinders 25, 26 can be controlled pneumatically, hydraulically or mechanically and driven electrically or else by remote control. Lifting cylinders 25, 26 in any case receive their switching pulse at the moment when an apparatus with which injector dosing means 1 is associated is operated, which shall be described below in more detail.

Figure 3:
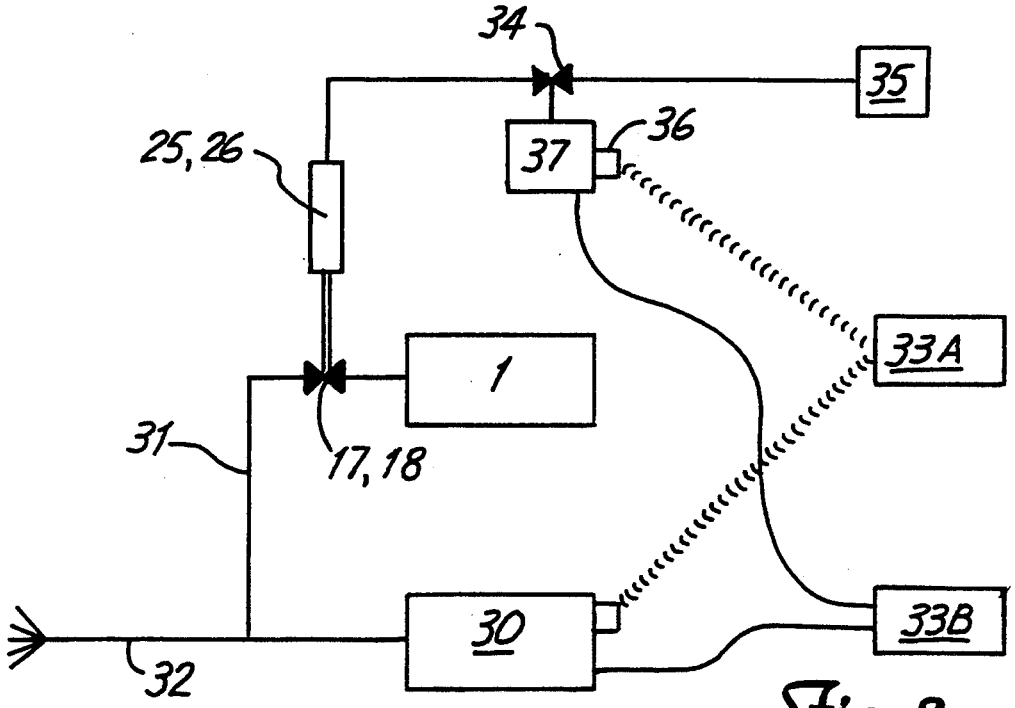

FIG. 3 shows a diagram of inventive injector dosing means 1 in conjunction with an apparatus which is embodied here by sandblasting means 30. From dosing means 1 at least one connecting pipe 31 extends to sandblasting means 30, opening into pipe 32 which carries the stream produced by sandblasting means 30. Pipe 31 can of course also be directed first into sandblasting means 30 and then open into pipe 32. It is likewise possible to connect pipes 31 and 32 at the end of pipe 32, where a jet nozzle is generally located. Pipe 31 contains one of control valves 17, 18 which, as mentioned above, is connected with a lifting cylinder 25, 26.

Sandblasting means 30 can be operated via a switch-on means 33. The diagram in FIG. 3 shows two different switch-on means, switch-on means **33*a* being a remote control unit and switch-on means 33*b* an electric switch. In any case switch-on means 33*a*, 33*b* can be used to switch a valve 34 which forms part of a switching means 38. Valve 34 is connected on one side with a pressure generator 35 and on the other side with lifting cylinder 25, 26. Valve 34 is operated here in such a way that when switch-on means 33 embodied by a remote control unit switches sandblasting means 30 the switching pulse is likewise intercepted by a receiver 36 of switching means 38, which feeds a signal to a drive 37 which in turn opens or closes valve 34 accordingly. If valve 34 is opened, for example, cylinders 25, 26 are pressurized and accordingly open or close control valve 17, 18. Pressure generator 35 may be a compressor, for example, which can likewise be used to operate sandblasting means 30 and to act upon container 2**.

Alongside the shown embodiment one can provide for each lifting cylinder 25, 26 a separate valve 34 which is controlled by a drive 37 associated with this valve. In this case the addition of the dosed agent is controlled fully automatically. It is no longer necessary to provide valves 15, 16 behind control valves 17, 18 in connections 11, 12 or in connecting pipe 31.

The sandblasting means can be used for moist sandblasting, i.e. with compressed air and a mixture, for washing, with compressed air and water, and for moist sandblasting and simultaneous washing, i.e. with compressed air and a mixture or compressed air and water.

Before the first use of injector dosing means 1 one should close ball valves 4, 6, 15 and 16. One must further check whether nozzles 13, 14 are firmly screwed into respective nozzle holders 19, 20, and whether nozzle holders 19, 20 themselves are tightened properly.

One must then check at display tube 9 whether container 2 is empty. If container 2 is not empty it must be emptied, as described below, if one cannot ascertain exactly which liquid is located therein. This also holds if the liquid to be poured in does not match the liquid located in container 2.

To fill injector dosing means 1 one should heed the above steps. For filling itself one closes ball valves 4, 15 and 16 while opening ball valve 6 to reduce any pressure still present in container 2. One then removes cap 8 from filler neck 7 and pours liquid into means 1. At display tube 9 one can check the level in container 2 and also control it at any time.

As already mentioned, injector dosing means 1 is preferably used with a moist sandblaster. It is expedient here for means 1 to be connected to a compressor of the moist sandblaster. One then closes ball valves 6, 15 and 16 and filler neck 7. One opens ball valve 4 so that container 2 can be subjected to compressed air.

If one is using the moist sandblaster with compressed air and a mixture, i.e. mixed blasting medium, ball valve 16 is opened while ball valve 15 remains closed. If one is using only compressed air and water (so-called washing), ball valve 15 is merely opened while ball valve 16 remains closed. If one is both blasting and washing, i.e. using both compressed air and a mixture and compressed air and water, both ball valves 15, 16 are opened.

As already mentioned, the injector dosing means is coupled with the moist sandblaster for operation therewith.

If the moist sandblaster is used for blasting proper and switched accordingly, lifting cylinder 26 also switches and opens valve 18. If the moist sandblaster is used only for washing and operated accordingly, lifting cylinder 25 switches and opens valve 17 while valve 18 remains closed. In double operation, i.e. washing and blasting, both lifting cylinders 25, 26 switch and open valves 17, 18 simultaneously. If the corresponding operation is discontinued the valves close via lifting cylinders 25, 26.

To switch off injector dosing means 1 ball valves 4, 15 and 16 are closed. Ball valve 6 is briefly opened to let off pressure from container 2. Nozzle holders 19, 20 with nozzles 13, 14 are turned off, and a container for catching the liquid is disposed below ball valves 15, 16 which are then opened. With the aid of pull rings 21, 22 lifting cylinders 25, 26 or valves 17, 18 are then opened. After the liquid has run out of container 2 nozzle holders 19, 20 with nozzles 13, 14 must be screwed back in.

I claim:

1. An injector for use in combination with a sandblaster apparatus for providing a liquid anticorrosive agent to a stream produced by the sandblaster apparatus, the sandblaster apparatus of the type having a switch-on means for activating and deactivating the sandblaster apparatus and having an outlet pipe for carrying the stream, the injector comprising:

a container for holding the liquid anticorrosive agent;

a connecting pipe having a plurality of branches extending from the container to the outlet pipe of the sandblaster apparatus to provide fluid communication between the container and the sandblaster apparatus;

a plurality of control valves disposed in the connecting pipe, with at least one control valve disposed in each branch of the connecting pipe, the valves being capable of opening to allow flow of the liquid agent through the connecting pipe to the outlet pipe of the sandblaster apparatus and capable of closing to prevent flow of the liquid agent through the connecting pipe to the outlet pipe of the sandblaster apparatus;

a plurality of nozzles with at least one nozzle disposed on each branch of the connecting pipe, wherein each nozzle has a different diameter; and a switching means for separately controlling each of the control valves and having a first mode for selectively opening the control valves and a second mode for selectively closing the control valves, the switching means being coupled to the switch-on means so that the switching means is in the first mode and opens the control valves when the switch-on means activates the sandblaster apparatus, and the switching means is in the second mode and closes the control valves when the switch on means deactivates the sandblaster apparatus.

2. The injector of claim 1 wherein the connecting pipe further includes: a hand-operated valve.

3. The injector of claim 1 wherein the container of the injector is connected with a pressure generator and is pressure sealed.

4. The injector of claim 1 wherein the switching means further comprises:

a valve driven via the switch-on means of the sandblasting apparatus, the valve being connected to a pressure generator;

a plurality of lifting cylinders pressurized via the valve and at least one lifting cylinder connected with each of the respective control valves for opening and closing the control valves.

5. The injector of claim 4 wherein the lifting cylinder is controlled pneumatically.

6. The injector of claim 1 wherein the switching means further comprises:

a drive for opening and closing the valve of the switching means;

a receiver for intercepting a pulse signal transmitted remotely by the switch-on means and for electrically sending the pulse signal to the drive of the valve of the switching means to activate the drive, the receiver being physically and electrically unconnected to the switch-on means.

7. The injector of claim 1 wherein the switching means further comprises:

a drive for opening and closing the valve of the switching means, the drive being connected electrically with the switch-on means.

8. The injector of claim 1 wherein the container has a bottom inclined downward toward an opening connected to the connecting pipe.

9. The injector of claim 1 wherein the injector is integrated into the sandblaster apparatus.

10. A sandblaster system comprising:

a sandblaster apparatus including an outlet pipe for producing a stream for sandblasting;

a switch-on means for activating and deactivating the sandblaster apparatus, the switch-on means being a remote control unit physically and electrically unconnected to the sandblaster apparatus;

an injector for providing a liquid anticorrosive agent to the stream produced by the sandblaster apparatus, the injector including:

a container for holding the liquid anticorrosive agent;

a connecting pipe extending from the container to the outlet pipe of the sandblaster apparatus to provide fluid communication between the container and the sandblaster apparatus;

a control valve disposed in the connecting pipe and being capable of opening to allow flow of the liquid agent through the connecting pipe to the outlet pipe of the sandblaster apparatus and capable of closing to prevent flow of the liquid agent through the connecting pipe to the outlet pipe of the sandblaster apparatus;

a switching means for controlling the control valve and having a first mode for opening the control valve and a second mode for closing the control valve, the switching means being coupled to the switch-on means so that the switching means is in the first mode and opens the control valve when the switch-on means activates the sandblaster apparatus, and the switching means is in the second mode and closes the control valve when the switch on means deactivates the sandblaster apparatus.

* * * * *

UNITED STATES PATENT AND TRADEMARK OFFICE

CERTIFICATE OF CORRECTION

PATENT NO. : 5,353,554

DATED : October 11, 1994

INVENTOR(S) : SIGRID KEIZERS

It is certified that error appears in the above-indentified patent and that said Letters Patent is hereby corrected as shown below:

On the Title page of the Patent, in [57] ABSTRACT, lines 13, 14 and 16, delete "[means]"

Col. 2, line 56, delete "dissection", insert --direction--

Col. 2, line 57, delete "hows", insert --shows--

Signed and Sealed this

Twenty-eight Day of March, 1995

*Attest:*

*Attesting Officer*

BRUCE LEHMAN

*Commissioner of Patents and Trademarks*